United States Patent [19]

Cook

[11] 4,252,495

[45] Feb. 24, 1981

[54] MECHANICAL HANDLING APPARATUS

[75] Inventor: Kenneth Cook, Aberford, England

[73] Assignee: Total Mechanical Handling Limited, Manchester, England

[21] Appl. No.: 712,777

[22] Filed: Aug. 9, 1976

[30] Foreign Application Priority Data

Aug. 14, 1975 [GB] United Kingdom ..... 33924/75

[51] Int. Cl.[3] ..... B66F 9/00

[52] U.S. Cl. ..... 414/608; 414/345; 414/592; 414/498; 280/43.12; 280/43.13

[58] Field of Search ..... 214/515, 620, 621, 41, 214/16.4 B, 16 B; 280/43.12, 43.13; 180/14 R, 14 A, 65 R, 2; 191/12.2 R; 414/608, 345, 592, 498, 659

[56] References Cited

U.S. PATENT DOCUMENTS

| | | | |
|---|---|---|---|
| 2,796,186 | 6/1957 | Arnot | 214/620 |
| 2,833,435 | 5/1958 | Levy | 214/515 |
| 3,243,194 | 3/1966 | Trusock | 280/43.12 |
| 3,797,678 | 3/1974 | Richardson | 191/12.2 R |
| 4,103,795 | 8/1978 | Miller | 414/592 |

FOREIGN PATENT DOCUMENTS

| | | | |
|---|---|---|---|
| 1429785 | 3/1976 | United Kingdom | 214/621 |

*Primary Examiner*—L. J. Paperner
*Assistant Examiner*—Lawrence E. Williams
*Attorney, Agent, or Firm*—Scrivener, Clarke, Scrivener and Johnson

[57] ABSTRACT

Mechanical handling equipment comprises a lift truck and a self powered pallet truck which is lifted into a trailer, etc. to be loaded by the lift truck with the load. The pallet truck is then remotely controlled by the lift truck driver to position the load at a desired location in the trailer.

5 Claims, 4 Drawing Figures

MECHANICAL HANDLING APPARATUS

Figure 1:
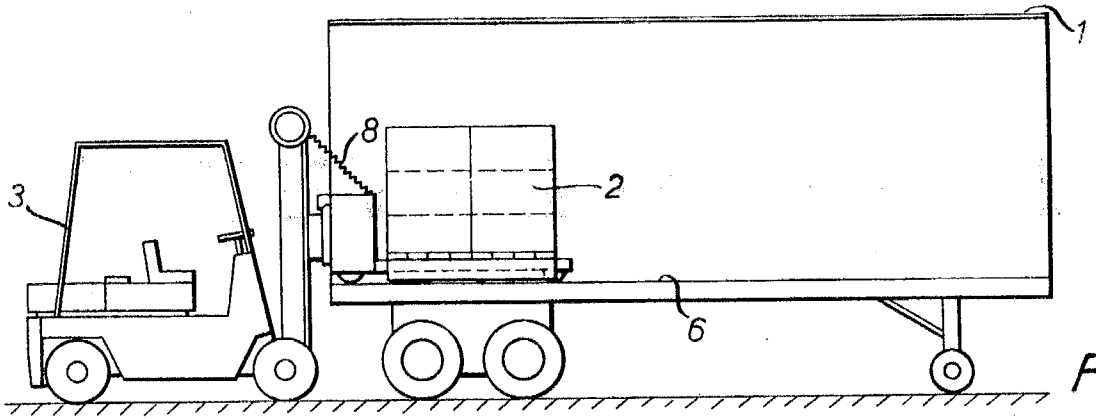

This invention relates to mechanical handling equipment and more particularly to equipment suitable for loading and unloading cargo vehicles.

In a materials handling application which requires the loading and unloading of palletised goods, particularly into and onto the decks of containers and lorries, where the floor of the container or lorry is above the normal work area, there is difficulty in obtaining access to the interior of an enclosed container or lorry by means of conventional fork lift trucks. More particularly, while a conventional fork lift truck can be used to lift a loaded pallet onto the floor of a lorry or container, it often cannot be used to move the pallet to a desired position in the lorry or container. For example, when loading a long container through open rear doors, a conventional fork lift truck cannot be used to position a load against the front end wall of the container because of the limited reach of the forks.

Attempts have been made to overcome this problem by providing loading bays and bridges or ramps to enable fork lift trucks to drive onto the floor of the container or lorry being loaded. This solution is not wholly satisfactory however, since it limits the loading and unloading of the lorry or container to specific locations having the required facilities, and since the confined working space and limited floor strength of a lorry or container limit the size of fork lift truck which can be employed.

Further, the use of large fork lift trucks within the confined working space of a lorry or container is not wholly satisfactory from the safety aspect and may result in injury to personnel working in the vicinity, or damage to the lorry or container or to the goods being loaded.

According to the present invention there is provided mechanical handling equipment comprising: a self-powered materials handling truck; a lift truck adapted to lift the materials handling truck and a load together from the ground and to position the materials handling truck and the load on an elevated surface with the load supported on the materials handling truck; and control means remote from the materials handling truck for controlling the operation of the materials handling truck.

The term "materials handling truck" as used herein means a truck capable of moving a load along a floor surface to a desired location and there depositing the load. The materials handling truck may, for example, be a pallet truck.

The remote control means may comprise a control box operable by the lift truck driver, and a control cable connecting the control box to the powered materials handling truck. Advantageously, the control box may be mounted on the lift truck. In a particularly preferred embodiment, in addition to the remote control means, control means are provided on the materials handling truck to enable an operator standing on or near the materials handling truck to control at least some of its functions. This arrangement is particularly advantageous when an operator sitting on the lift truck cannot see the materials handling truck clearly because, for example, of an intervening obstruction.

Figure 2:
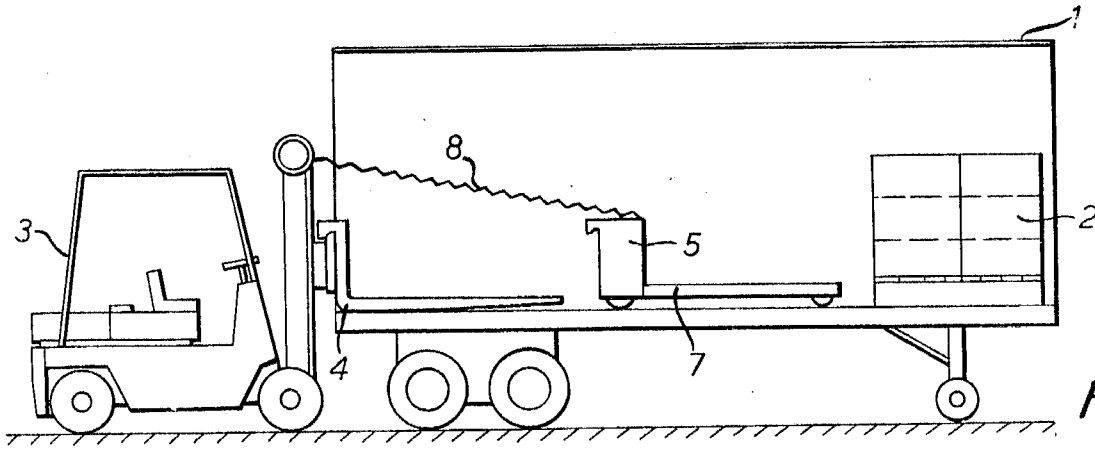
Figure 3:
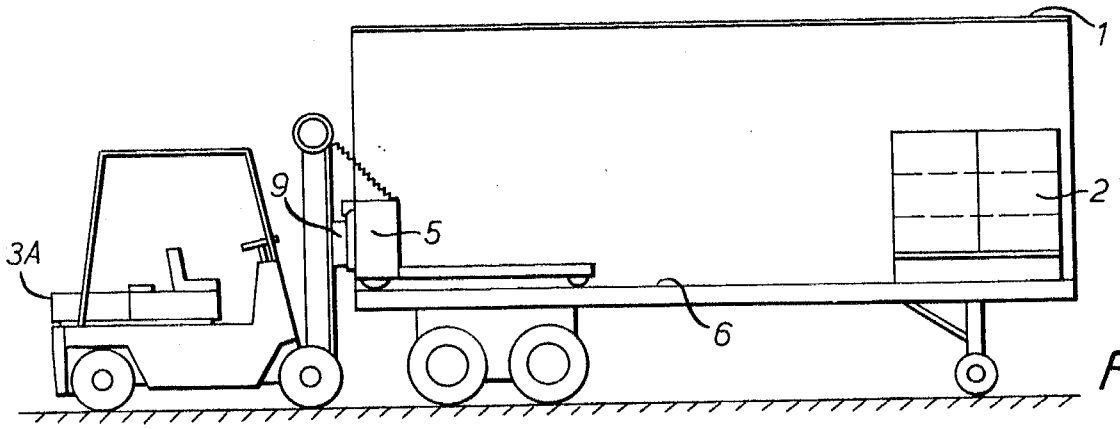
Figure 4:
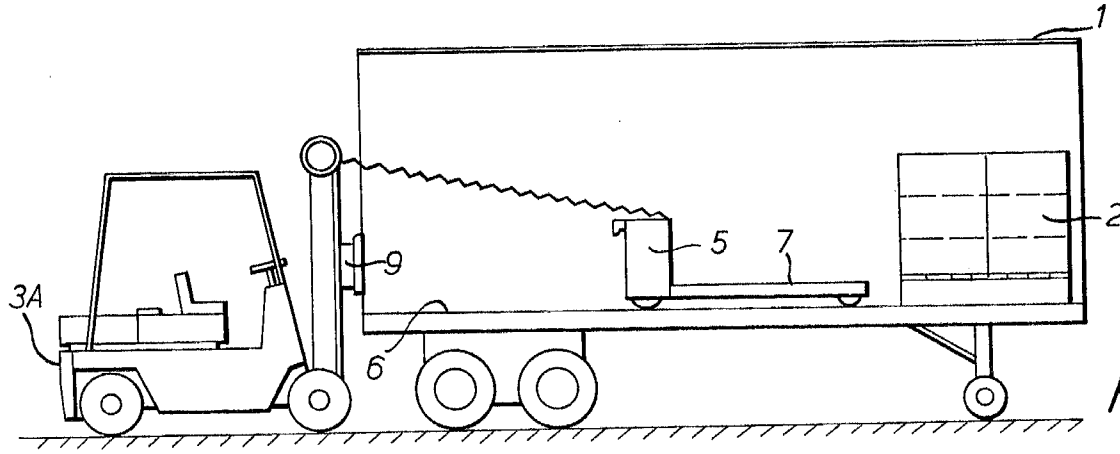

The invention will be better understood from the following description of preferred embodiments, given by way of example only, reference being had to the accompanying drawings; wherein:

FIGS. 1 and 2 show a first embodiment of mechanical handling equipment; and FIGS. 3 and 4 show a second embodiment of mechanical handling equipment.

FIGS. 1 and 2 show a covered trailer 1 which is being loaded with a palletised cargo, one pallet load 2 of which is shown in the drawing. Loading the trailer is a mechanical handling device comprising a fork lift truck 3 having forks 4 having its own self-contained energy source such as batteries housed within its body, and a self powered pallet truck 5. The pallet truck may, for example, be an electric pallet truck which derives its operating power from batteries housed within its body and constituting a self-contained energy source separate from the energy source on the lift truck. The pallet truck is designed to be lifted from the ground by the fork carriage of the lift truck 3 at the same time as a loaded pallet is lifted, and to be positioned on the floor 6 of the lorry 1 with its forks 7 beneath the loaded pallet (FIG. 1) so that it can be used to move the loaded pallet to a position remote from the lift truck. The pallet truck is controlled by the lift truck driver via a control box and a control cable 8 which extends between the control box and the pallet truck.

Once the pallet truck has positioned a loaded pallet at a desired location it lowers the loaded pallet under the control of the lift truck driver and is recalled (FIG. 2) for removal from the trailer by the lift truck ready to load another pallet.

In the case of the embodiment of FIGS. 3 and 4, the lift truck 3A is not provided with forks but with a lift carriage 9 adapted to engage brackets on the pallet truck. Thus, when the pallet truck brackets are engaged with the lift carriage (FIG. 3), the forks 7 of the pallet truck are, in effect, the forks of a fork lift truck. To load a pallet onto the trailer 1, the forks of the pallet truck are inserted under the pallet and the pallet is raised by moving the pallet truck up the mast of the lift truck on the lift carriage. The pallet truck is then lowered onto the floor of the trailer 1, and is detached from the lift carriage. The loaded pallet is then positioned on the trailer as described with respect to FIGS. 1 and 2.

Preferably, the controls of the materials handling truck are duplicated, one set of controls being within the reach of the lift truck driver and the other set being located on the materials handling truck so that if a load is to be deposited precisely or at a location out of the view of the lift truck driver, an operator standing on or near the materials handling truck may control its operation.

The control cable 8 may be a coiled extensible cable, or may be a flexible cable wound on a suitable dispensing reel on the lift truck. The cable may include separate conductors to control each function of the materials handling truck, or may have less conductors than the number of controlled functions, in which case the control box will include suitable encoding circuitry and the materials handling truck will include suitable decoding circuitry. For example, a truck having raise/lower/steer left/steer right/reverse forward/fast/slow/ and brake control functions may be controlled through a 5-core control cable if suitable diode encoding circuitry is provided in the control box and a decoder unit is provided at the materials handling truck end of the control cable.

Whilst the materials handling truck of the preferred embodiment is an electric pallet truck, it should be appreciated that any suitable self-powered materials handling truck may be used, for example a straddle truck or a counter-balanced truck or a standon truck. If the materials handling truck is electrically powered, the various control functions may be obtained using electric motors and mechanical transmissions or by means of hydraulic drive devices fed from one or more electrically powered pumps.

The materials handling equipment described above can, of course, be used for unloading lorries and for other mechanical handling applications where more reach than that offered by conventional fork lift trucks is desired.

What is claimed is:

1. Mechanical handling equipment comprising: a material handling truck; a lift truck adapted, constructed and arranged to lift the material handling truck and a load together from the ground and to position the material handling truck and the load on an elevated surface with the load supported on the material handling truck; powering means including a first self-contained energy source carried by said lift truck, self-powering means including a second self-contained energy source carried by said material handling truck, the energy source carried by said material handling truck being electrically controlled and being independent of the energy source carried by said lift truck, a control box carried by said lift truck, and flexible electrical cable means connecting said control box to the controls for the self-contained energy source on said material handling truck to control from said lift truck the operation of said self-powering means by the self-contained energy source on the material handling truck when the latter is separated from said lift truck.

2. Mechanical handling equipment according to claim 1 wherein control means are additionally provided on the materials handling truck to permit control of the self-powering means of the materials handling truck by an operator standing on or near the materials handling truck.

3. Mechanical handling equipment according to claim 1 wherein the lift truck is a fork lift truck the forks of which support the load during lifting of the materials handling truck and load.

4. Mechanical handling equipment according to claim 1 wherein the lift truck has a lift carriage on which the materials handling truck may be mounted in such a manner that during lifting of the materials handling truck and load, the load is supported on the materials handling truck.

5. Mechanical handling equipment according to claim 1 wherein the materials handling truck is a battery powered pallet truck.

* * * * *